US008443556B2

(12) United States Patent
Hiscock et al.

(10) Patent No.: US 8,443,556 B2
(45) Date of Patent: May 21, 2013

(54) WALL CLIP AND SHIM ADAPTED FOR INSULATING CONCRETE WALLS AND SIMILAR MATERIALS

(75) Inventors: Barry Hiscock, Port Hope (CA); Sheldon Warman, Oakville (CA)

(73) Assignee: ARXX Corporation (CA)

( * ) Notice: Subject to any disclaimer, the term of this patent is extended or adjusted under 35 U.S.C. 154(b) by 0 days.

(21) Appl. No.: 13/474,520

(22) Filed: May 17, 2012

(65) Prior Publication Data

US 2012/0227214 A1 Sep. 13, 2012

Related U.S. Application Data

(62) Division of application No. 12/790,267, filed on May 28, 2010, now Pat. No. 8,205,406.

(51) Int. Cl.

| | |
|---|---|
| ***E04B 2/82*** | (2006.01) |
| ***E04B 9/00*** | (2006.01) |
| ***E04G 1/22*** | (2006.01) |

(52) U.S. Cl.

USPC ..... 52/126.1; 52/217; 16/247

(58) Field of Classification Search

USPC ..... 52/302.1, 309.2, 309.7, 309.16, 293.3, 52/379, 506.6, 506.08, 506.09, 506.1, 510, 52/511, 126.1, 217; 16/247

See application file for complete search history.

(56) References Cited

U.S. PATENT DOCUMENTS

| | | | | |
|---|---|---|---|---|
| 3,005,282 | A * | 10/1961 | Christiansen | 446/128 |
| 3,162,973 | A * | 12/1964 | Christiansen | 446/128 |
| 4,713,922 | A | 12/1987 | Ingold | |
| 6,050,044 | A * | 4/2000 | McIntosh | 52/591.1 |
| 6,102,766 | A * | 8/2000 | Leadbetter et al. | 446/128 |
| 6,159,575 | A * | 12/2000 | Rathsack | 428/80 |
| 6,314,694 | B1 | 11/2001 | Cooper et al. | |
| 6,438,918 | B2 | 8/2002 | Moore, Jr. et al. | |
| 6,560,934 | B1 * | 5/2003 | Workman | 52/126.1 |
| 6,645,033 | B1 * | 11/2003 | Thomsen | 446/120 |
| 8,033,066 | B2 | 10/2011 | Giffiths | |
| 8,042,228 | B2 * | 10/2011 | Jones | 16/221 |
| 8,105,128 | B1 * | 1/2012 | Sorensen et al. | 446/128 |
| 2007/0022682 | A1 | 2/2007 | Morgenegg et al. | |
| 2008/0104918 | A1 | 5/2008 | Gleeson et al. | |
| 2009/0241451 | A1 | 10/2009 | Griffiths | |
| 2010/0058678 | A1 * | 3/2010 | Lutz et al. | 52/126.1 |
| 2011/0252728 | A1 | 10/2011 | Scherrer | |

OTHER PUBLICATIONS

ECO-Block, LLC, ECO-Block Panel Wall Mounting Clip, Brochure, admitted prior art, no date, 1 pg.

ICF Builder, The Insulating Concrete Forms Magazine, "Using ICFs for Retrofits and Remodels," Apr./May 2010, pp. 11-15.

R-ETRO Systems, Product Manual Version 1.1, Jul. 2008, 38 pgs.

* cited by examiner

*Primary Examiner* — Brian Glessner
*Assistant Examiner* — Brian D Mattei
(74) *Attorney, Agent, or Firm* — Kilpatrick Townsend & Stockton, LLP

(57) ABSTRACT

A stackable shim system. A first shim includes a receiving feature, an attachment feature, and a main portion having a first thickness. A second shim also includes a receiving feature, an attachment feature, and a main portion having a second thickness. The receiving feature of each shim is configured to engage with the attachment feature of the other shim such that either shim can be removably attached to the other to create a stacked shim having a main portion having a thickness that is the sum of the first and second thicknesses. The shims may be conveniently used for taking up space and/or accommodating for irregularities in construction materials.

11 Claims, 16 Drawing Sheets

WALL CLIP AND SHIM ADAPTED FOR INSULATING CONCRETE WALLS AND SIMILAR MATERIALS

CROSS REFERENCE TO RELATED APPLICATIONS

This application is a division of U.S. patent application Ser. No. 12/790,267, filed May 28, 2010, entitled "Wall Clip and Shim Adapted For Insulating Concrete Walls And Similar Materials," the entire disclosure of which is hereby incorporated by reference as if fully set forth herein.

BACKGROUND OF THE INVENTION

It is often desirable to add insulation to an existing wall of a home or other building, for example to reduce the cost of heating and cooling the building. Often, additional insulation is provided as part of a project that includes other treatments to the wall as well.

In one common situation, a home or other building may have a basement with walls of poured concrete, concrete block, or a similar material. During finishing of the basement, insulation may be placed at the wall and finishing materials place over the insulation. A common previous technique for finishing a basement wall is to frame a wood-framed wall spaced just inside of the basement wall, place batt insulation between framing members of the wood-framed wall, and then attach finishing materials to the interior surface of the wood-framed walls. Common finishing materials would include paneling or drywall board, which may be nailed or screwed to the wood frame of the wood-framed wall. Wood frame construction is time consuming and complex.

Some other techniques for adding insulation to an existing basement have been developed. For example, insulating foam sheets may be adhered or attached to the basement wall. However, previous attachment methods have not provided any ability to compensate for irregularities in the wall. As is well known, concrete walls, especially existing walls in older buildings, may not be precisely vertical, and may include various other irregularities that result from the concrete forming and pouring process. For a pleasing finished look, it is desirable that the finished basement have vertical, planar walls.

There are also other situations in which it is desirable to add insulation to a wall. For example, additional insulation may be added to an exterior wall of a home or building, often in conjunction with a home renovation that may also include providing a new outer surface material for the building. Walls may also be insulated during new construction.

BRIEF SUMMARY OF THE INVENTION

The invention provides various advantageous embodiments of clips and shims and methods to facilitate the attachment of one or more insulating panels to a wall in a more efficient and effective manner than conventional methods. The shims may have applicability in a variety of applications in addition to the attachment of insulating panels. The invention may be implemented in a number of ways.

According to a first aspect of the invention, a system for insulating a wall includes a first foam panel having a top, bottom, and first and second sides. A first plurality of web members is disposed in the first foam panel, each web member including an end plate proximate the first side of the panel and each web member including a plurality of attachment features. The system further includes a clip having first and second ends and a main body between the ends. The clip includes a first connection feature at the first end of the clip, the first connection feature complementarily engaging one of the attachment features of the first foam panel, and the clip includes a second connection feature configured to complementarily engage an attachment feature of a second foam panel. The main body of the clip defines at least one opening to receive a fastener for fastening the clip to the wall. The system according to this aspect further includes a shim removably attached to the clip such that, when the system is affixed to the wall, the shim resides between the clip and the wall, and the thickness of the shim contributes to the distance by which the respective attachment feature is spaced from the wall.

In some embodiments, the second foam panel may be disposed above the first foam panel. Each end plate may be at least partially embedded within the first foam panel, such that a thickness of foam covers the end plate and forms a portion of the surface of the first side of the first foam panel. In other embodiments, a surface of each end plate may be exposed at the first side of the first foam panel. When the system is affixed to the wall, the first foam panel may be spaced from the wall by a distance greater than one quarter inch. In some embodiments, the first foam panel is spaced from the wall to form a clearance gap for moisture, insulation, and/or HVAC utility lines/access.

In some embodiments, the attachment features of the first foam panel may protrude from the second side of the first foam panel. The shim may be a first shim, with the system further including a second shim removably attached to the first shim such that, when the system is affixed to the wall, the second shim resides between the first shim and the wall, and the combined thicknesses of the two shims contributes to the distance by which the respective attachment feature is spaced from the wall.

In other embodiments, the system further includes a second foam panel also having a top, bottom, and first and second sides. A second plurality of web members may be disposed in the second foam panel, each web member including an end plate proximate the first side of the second foam panel and each web member including a plurality of attachment features. The second foam panel may be disposed adjacent the first foam panel, with an attachment feature of the second foam panel complementarily engaging the second connection feature of the clip. The second foam panel may be disposed above the first foam panel.

In some embodiments, the system further includes a channel under the first foam panel, the channel including two walls between which the bottom of the first foam panel resides, with the channel constraining the bottom of the first foam panel to reside a fixed distance from the wall. The channel may be configured to attach to a floor under the first foam panel. The channel may further include a spacer extending from the channel and a third wall extending from the spacer, the third wall configured to provide an attachment of the channel to the wall being insulated.

In some embodiments, the first foam panel may be affixed to an interior wall of a basement, and in other embodiments, the first foam panel may be affixed to an exterior wall of a building.

According to another aspect of the invention, a method of insulating a wall includes engaging a clip with an attachment feature of a web member disposed in a foam panel, and removably attaching a shim to the clip. The foam panel, the clip, and the shim according to this aspect are affixed to the wall using a fastener through the shim and the clip. In some embodiments, the foam panel is a first foam panel, the clip is a first clip, and the fastener is a first fastener, and the method further includes engaging a first attachment feature of a web member disposed in a second foam panel with the first clip, with the second foam panel adjacent the first and forming part of a second course of panels disposed above or below the first panel. A second clip may be engaged with an attachment feature of the web member disposed in the second foam panel, and the second foam panel and the second clip affixed to the wall using a second fastener through the second clip.

In some embodiments, a finishing material may be attached to the foam panels by engaging fasteners with end plates of the web members. The wall may be an interior wall, and in some embodiments the wall may be an exterior wall.

According to another aspect of the invention, a clip for attaching insulating foam panels to a wall includes first and second ends and a main body between the ends, the main body defining at least one opening to receive a fastener for fastening the clip to the wall. The clip also may include a first connection feature at the first end of the clip, the first connection feature configured to complementarily receive an attachment feature of a first one of the foam panels. A second connection feature may be included at the second end of the clip, the second connection feature configured to complementarily receive an attachment feature of a second one of the foam panels spaced adjacent the first. Also according to this aspect, a shim receiving feature of the clip is configured to removably attach a shim to the clip such that the thickness of the shim contributes to a distance by which a respective attachment feature is spaced from the wall.

In some embodiments, each connection feature of the clip includes a slotted pocket configured to receive a respective T-shaped attachment member. The shim receiving feature may include two tabs, one tab protruding from each of two sides of the clip. In other embodiments, the shim receiving feature includes compliant ribs molded into the clip and configured to removably hold a shim to the clip by friction between the compliant ribs and a protrusion of the shim.

In some embodiments, the clip is combined with a shim removably attached to the clip. The shim may be a first shim that includes a shim receiving feature like the shim receiving feature of the clip, configured to removably attach a second shim such that the combined thickness of the first and second shims contributes to a distance by which a respective attachment feature is spaced from the wall.

According to another aspect of the invention, a stackable shim system includes a first shim that includes a receiving feature, an attachment feature, and a main portion having a first thickness, and the stackable shim system includes a second shim that also includes a receiving feature, an attachment feature, and a main portion having a second thickness. The receiving feature of each shim according to this aspect is configured to engage with the attachment feature of the other shim such that either shim can be removably attached to the other to create a stacked shim having a main portion having a thickness that is the sum of the first and second thicknesses. The two shims may be substantially identical. The two shims may differ in thickness.

In some embodiments, the receiving feature of each shim includes two tabs, one tab protruding from each of two opposite sides of the shim, and the attachment feature of each shim comprises a generally C-shaped channel configured to complementarily engage with the receiving feature of the other shim. A detent feature may be provided for holding the two shims in stacked arrangement.

In other embodiments of the stackable shim system, the receiving feature of each shim comprises a set of compliant ribs, the attachment feature of each shim comprises a protrusion, and the two shims may be removably attached by friction between the protrusion of one shim and the compliant ribs of the other shim. The main portion of each shim may define at least one through opening for receiving a fastener, and when the first and second shims are attached to form the stacked shim, the openings may align such that the stacked shim also defines a through opening for receiving a fastener.

According to another aspect of the invention, a method of forming a stacked shim for taking up space and/or accommodating for irregularities in construction materials includes providing a first shim including a receiving feature and a first main portion having a first thickness, and also providing a second shim including an attachment feature and a second main portion having a second thickness. According to this aspect, the first shim is removably attached the second shim by engaging the attachment feature of the second shim with the receiving feature of the first shim, such that a stacked shim is formed having a main portion having a third thickness that is the sum of the first and second thicknesses.

In yet another aspect of the invention, a method of creating a supporting wall structure includes providing a wall-mountable web member configured to attach to a wall, the wall-mountable web member including a plurality of attachment features, and a foam panel having a top, bottom, and first and second sides. The foam panel includes a plurality panel web members disposed in the foam panel, each panel web member including an end plate proximate the first side of the foam panel and a plurality of attachment features. The method further includes providing a plurality of connectors, each connector having first and second ends, the first end including a feature configured to complementarily engage with an attachment feature of the wall-mountable web member, and the second end including a feature configured to complementarily engage with an attachment feature of one of the panel web members. The wall-mountable web member is affixed to the wall, and the first foam panel is positioned with its second side generally parallel with and spaced from the wall. Each of the connectors is engaged with a respective attachment feature of the wall-mountable web member and with a respective attachment feature of one of the panel web members. The foam panel may be held by the connectors in a generally spaced parallel relationship with the wall to create a cavity between the foam panel and the wall, and the method may further include pouring concrete in the cavity. In some embodiments, the connectors include saddles for supporting rebar, and the method further includes providing rebar disposed in the saddles of the connectors prior to pouring the concrete in the cavity. A finishing material may be attached to the first side of the foam panel by engaging fasteners with the end plates in the panel web members.

The method described immediately above may further include providing multiple wall-mountable web members affixed to the wall, providing multiple foam panels having panel web members disposed therein, connecting a first set of the foam panels to a first set of the wall-mountable web members to form a first course of foam panels along the wall, and connecting a second set of the foam panels to a second set of the wall-mountable web members to form a second course of foam panels along the wall, with the second course being disposed above the first.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention claimed. The detailed description and the specific examples, however, indicate only preferred embodiments of the invention. Various changes and modifications within the spirit and scope of the invention will become apparent to those skilled in the art from this detailed description.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced. In the drawings.

DETAILED DESCRIPTION OF THE INVENTION

Figure 1:
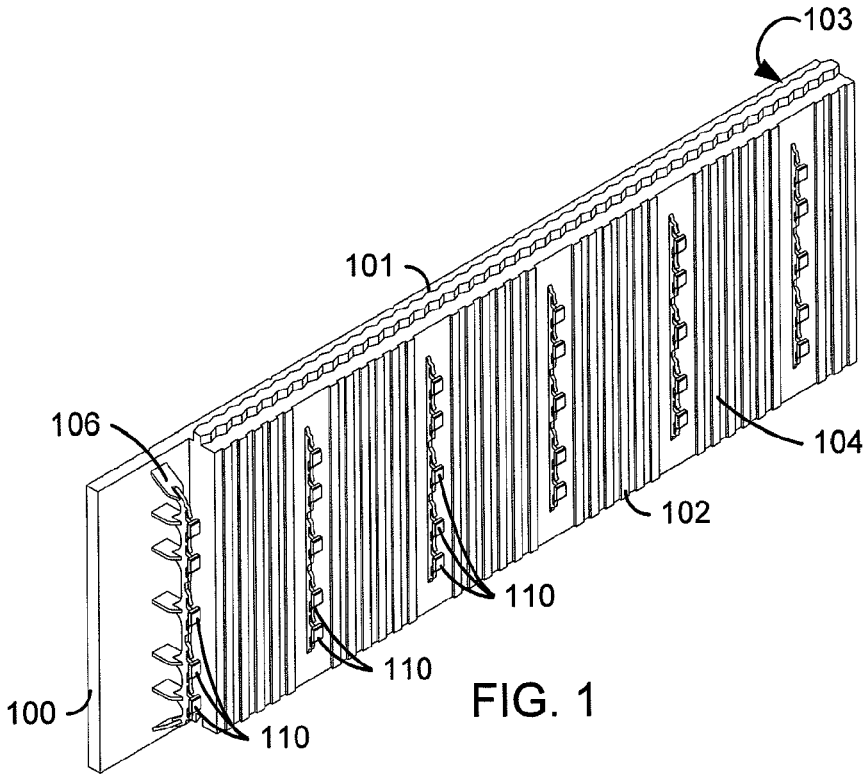
FIG. 1 is a partially cutaway oblique view of an exemplary foam panel suitable for use in embodiments of the invention.

It is understood that the invention is not limited to the particular methodology, components, and systems, etc., described herein, as these may vary as the skilled artisan will recognize. It is also to be understood that the terminology used herein is used for the purpose of describing particular embodiments only, and is not intended to limit the scope of the invention. It also is be noted that as used herein and in the appended claims, the singular forms "a," "an," and "the" include the plural reference unless the context clearly dictates otherwise. Thus, for example, a reference to "a panel" is a reference to one or more panels and equivalents thereof known to those skilled in the art.

Unless defined otherwise, all technical and scientific terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals reference similar parts throughout the several views of the drawings.

FIG. 1 is a partially cutaway oblique view of an exemplary insulating foam panel 100 suitable for use in embodiments of the invention. Foam panel 100 has a top 101, bottom 102, a first side 103 (not visible in FIG. 1) and a second side 104. Foam panel 100 may have a height of about 16 inches, a length of about 48 inches, and a thickness of about 2.5 inches, although one of skill in the art will recognize that embodiments of the invention may use panels having other dimensions. Foam panel 100 may preferably be made of expanded polystyrene or another foam material having good insulation properties and adequate mechanical strength. Various external textures, ribbing, interlocking tabs and grooves, or other features may be provided on foam panel 100, within the scope of the appended claims.

Figure 2:
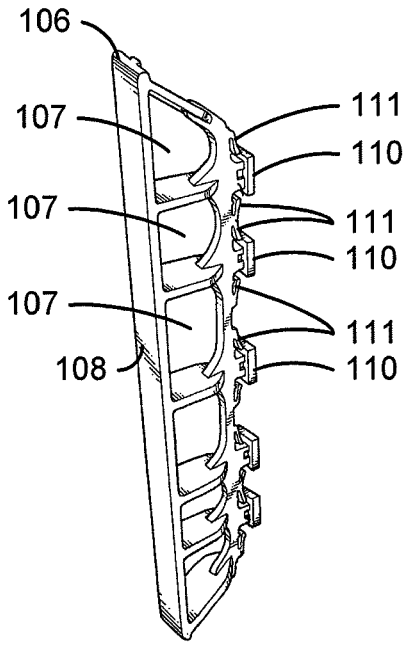
FIG. 2 shows an exemplary web member.
Figure 3:
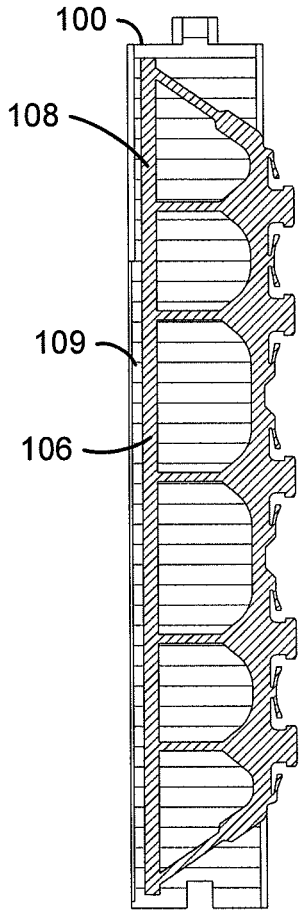
FIG. 3 shows a cross section view of the foam panel of FIG. 1, illustrating how the web member of FIG. 2 may be embedded in the panel.

At least partially embedded in panel 100 are several exemplary web members 106. Each web member 106 may be molded of polypropylene, high impact polystyrene (HIPS), acrylonitrile butadiene styrene (ABS), or another suitable polymer. In other embodiments, the web members may be made of metal or other materials. FIG. 2 shows an exemplary web member 106 in isolation. FIG. 3 shows a cross section view of foam panel 100, illustrating how web member 106 may be embedded in panel 100 in any manner known in the art. Web member 106 includes openings 107 through which foam material flows during molding of panel 100, so that web member 106 is firmly and strongly embedded. Many other configurations of web members could be used within the scope of the appended claims.

Figure 1A:
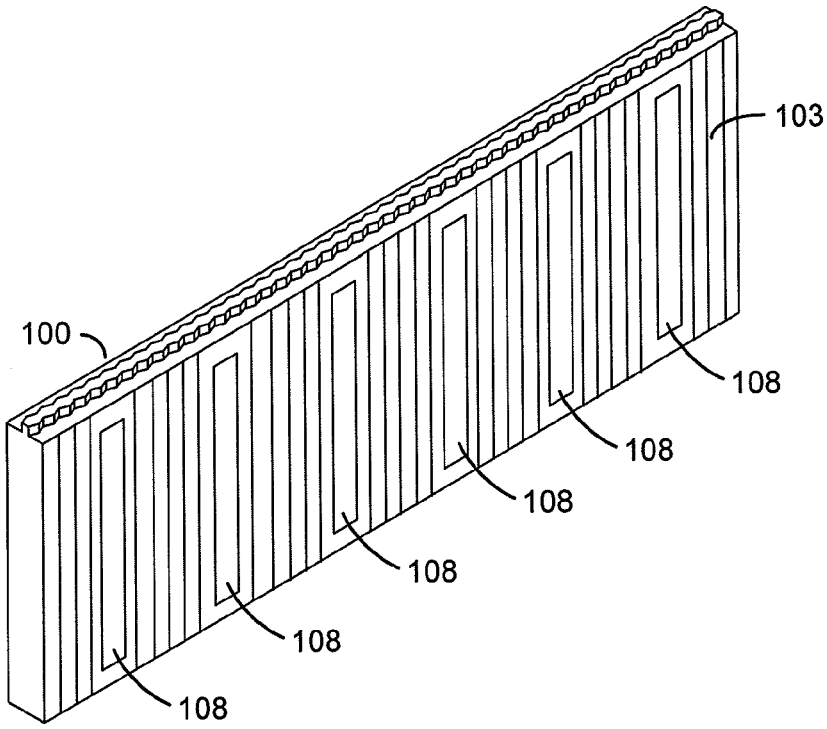
FIG. 1A shows a reverse oblique view of the exemplary foam panel of FIG. 1.

Each web member 106 includes an end plate 108 near the first side 103 of panel 100. End plates 108 will provide a structural mount for paneling, drywall board, stucco, or other finishing materials on the completed wall. In this example, end plate 108 is buried within panel 100, such that a thickness of foam 109 covers the end plate and forms the outside surface of the first side 103 of the panel. It is also contemplated that the outside surface of end plate 108 could be exposed on the side of panel 100, substantially flush with the outside surface of the first side 103 of the panel, slightly raised from the surface of side 103 or partially embedded in the foam 109. FIG. 1A illustrates a reverse angle view of panel 100, showing end plates 108 exposed at side 103.

In the arrangement of panel 100, web members 106 include attachment features 110 that protrude from second side 104 of panel 100. Attachment features 110 will be used in attaching panel 100 to the wall. While exemplary attachment features 110 protrude from panel 100, many other kinds of attachment features could be used within the scope of the appended claims. For example, other panels according to other embodiments may have attachment features that are internal to the panel and not readily visible. Also associated with exemplary attachment features 110 are flexible tip features 111, best seen in FIG. 3, that enable a clip to be snapped onto an attachment feature, as is explained in more detail below.

One example of a particularly advantageous foam panel suitable for use in embodiments of the invention is an ARXX Edge™ standard panel block available from ARXX Corporation of Cobourg, Ontario, Canada. In other embodiments, the web members may be disposed in the foam panel without being embedded during the molding of the foam panel, for example by insertion of a web member into a cavity formed in a previously molded foam panel.

Figure 4:
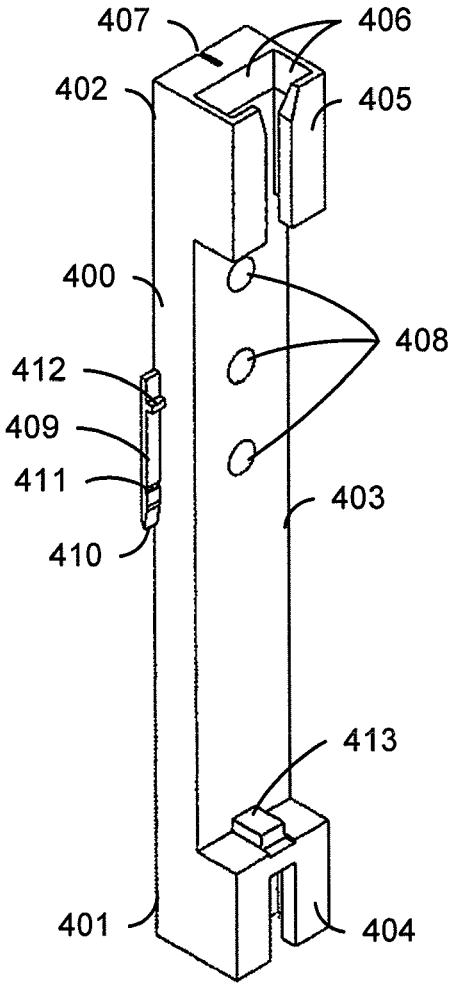
FIG. 4 illustrates one embodiment of a clip constructed in accordance with the principles of the invention for mounting panels to a wall.

FIG. 4 illustrates an example embodiment of a clip 400 made in accordance with the principles of the invention for mounting panels such as foam panel 100 to a wall. Clip 400 may preferably be molded of polypropylene, high impact polystyrene (HIPS), acrylonitrile butadiene styrene (ABS), or another suitable polymer. In other embodiments, the clip may be made of metal or other materials. Exemplary clip 400 includes a first end 401 and a second end 402, and a main body 403 between the ends 401 and 402. Connection features 404 and 405 reside respectively at ends 401 and 402. Connection feature 404 is configured to complementarily engage one of the attachment features 110 of web member 106. Connection feature 405 is configured to complementarily engage an attachment feature of another panel. In this example embodiment, connection features 404 and 405 include slotted pockets or channels that can receive the T-shaped (as viewed from the top) attachment members 110. Many other kinds of connection features could be used within the scope of the appended claims. For example, clip 400 could include male connection features configured to engage with female attachment features of panel 100. The attachment features and connection features could engage via a dovetail arrangement, could connect using a hook, latch, or snap arrangement, or could be connected in some other way. Many variations are possible. Example connection feature 405 includes a lead-in taper 406 surrounding the upper perimeter of the slotted pocket for facilitating engagement with one of the attachment members. To form lead-in taper 406, the upper edges of the slotted pocket of connection feature 405 are beveled, sloping upwardly and outwardly so that the uppermost perimeter of the pocket is larger than the throat of the pocket. A centering mark 407 molded into the clip 400 may be used for aligning the clip during attachment to the wall. Through holes 408 are configured to accept fasteners for affixing clip 400 to the wall.

Example clip 400 includes two tabs 409 (only one tab is visible in FIG. 4) each protruding from one of the sides of clip 400. These tabs serve as receiving features for shims that can be used to adjust for irregularities in the wall, as is explained in more detail below. Each shim receiving tab includes features for sliding a shim onto the tab and snapping the shim to the tab. For example, inclined ramp 410 guides a shim onto tab 408, a feature of the shim may snap into depression 411, and stop 412 limits the travel of the shim. Protrusion 413 enables snapping clip 400 onto one of attachment features 110.

Figure 5:
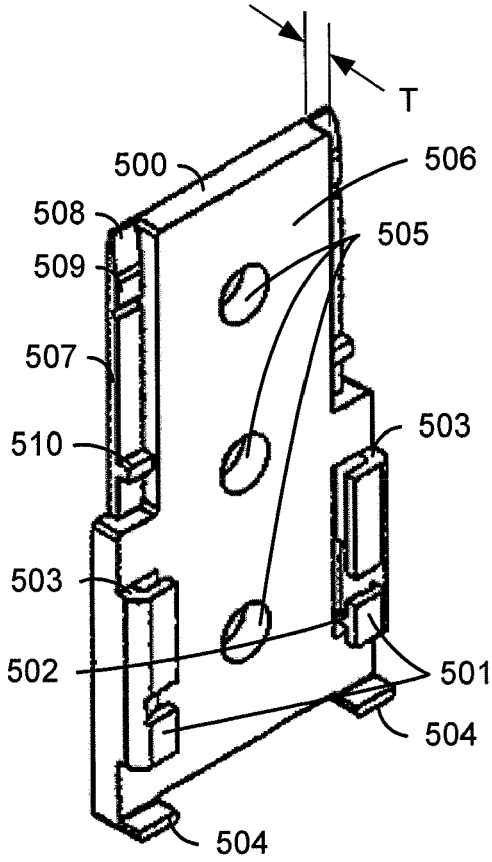
FIG. 5 illustrates a shim constructed according to the principles of the invention, which is configured to mate with the clip of FIG. 4.

FIG. 5 illustrates one embodiment of a shim 500 configured to mate with clip 400, in accordance with the principles of the invention. Shim 500 may also preferably be molded of polypropylene, high impact polystyrene (HIPS), acrylonitrile butadiene styrene (ABS), or another suitable polymer, or formed from other materials in other embodiments. Shim 500 includes two spaced C-shaped channels 501 disposed at the sides of the body 500 of the shim and configured to engage tabs 409 of clip 400. C-shaped channels 501 thus serve as shim attachment features for attaching shim 500 to clip 400 or another shim. A male snap feature 502 is positioned to snap into depression 411 of clip 400 when shim 500 has reached its proper position. Ends 503 of C-shaped channel 501 are also positioned to meet stops 412 to limit the travel of shim 500. Tabs 504 "error-proof" the assembly so that shim 500 cannot be placed on clip 400 in an incorrect orientation.

Through holes 505 are positioned so that when shim 500 is properly attached to clip 400, holes 505 align with holes 408 to receive one or more fasteners for affixing the assembly to the wall. Main portion 506 of shim 500 has a thickness T, which may be chosen as needed. For example, T may be ⅛ inch, ¼ inch, 2 millimeters, or another useful thickness. Multiple, mating shims of differing thickness may be provided to accommodate varying irregularities in the wall.

Accordingly, exemplary shim 500 also includes features for attaching another shim, including tabs 507, ramp 508, depression 509, and stop 510, substantially identical to tabs 409, ramp 410, depression 411, and stop 412 of clip 400. These features enable a second shim to be attached to the first, so that the shims stack and their thicknesses add to form a stacked shim having a thickness that is the sum of the thicknesses of the shims in the stack.

Figure 6A:
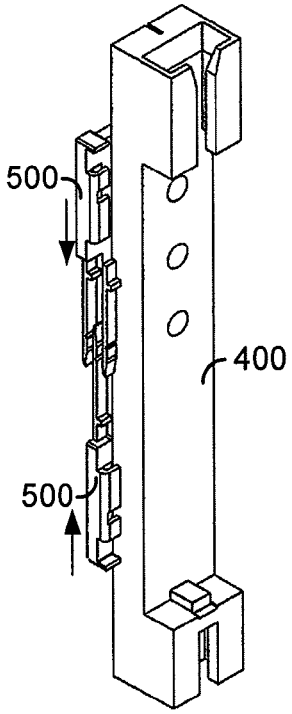
FIG. 6A illustrates the clip of FIG. 4 and two of the shims of FIG. 5 in position for attachment to the clip.
Figure 6B:
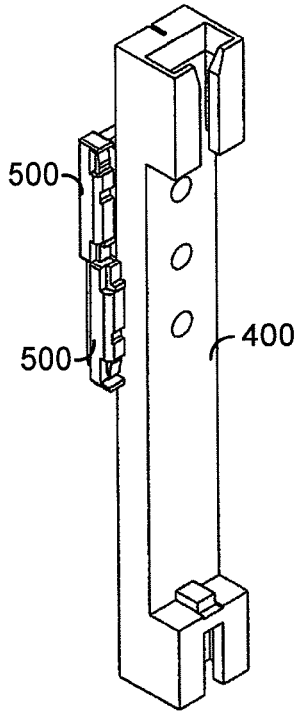
FIG. 6B illustrates the clip and shims of FIG. 6A after attachment.

FIG. 6A illustrates clip 400 with two shims 500 in position for attachment to clip 400, and FIG. 6B illustrates the assembly after both shims 500 have been attached to clip 400.

In this way, any number of shims may be combined by simply rotating each shim 180 degrees with respect to the previous shim and snapping the shims together.

Once clip 400 and one or more shims 500 are assembled, they are removably attached to each other. For the purposes of this disclosure, to be "removably attached" means that parts are attached sufficiently securely that they will not inadvertently separate during normal handling and positioning of the assembled parts in later assembly steps, but that the parts can be intentionally separated if desired by the application of sufficient force or actuating a release mechanism without breaking or damaging the parts. For example, exemplary clip 400 and shim 500 are removably attached by virtue of the snapping action between male snap feature 502 and depression 411. Once assembled, clip 400 and shim 500 may be conveniently handled as a unit without risk of inadvertent separation. However, if it is desired to remove a shim from the assembly, it can be removed by applying sufficient force to overcome the detent action of the snap features. Many other kinds of removable attachments are possible. For example, clip 400 may be removably attached to one of attachment features 110 without a snap feature, and may be sufficiently held in place by light friction or by the orientation of the components.

Figure 7A:
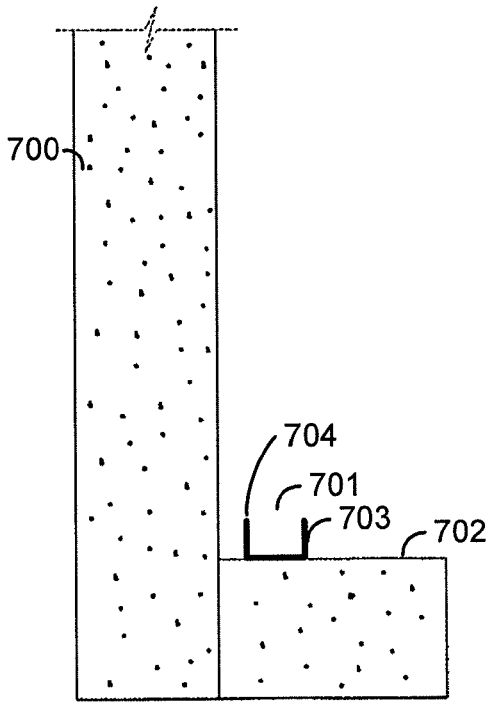
FIG. 7A illustrates a first step of an exemplary wall insulation method in accordance with the principles of the invention.
Figure 7B:
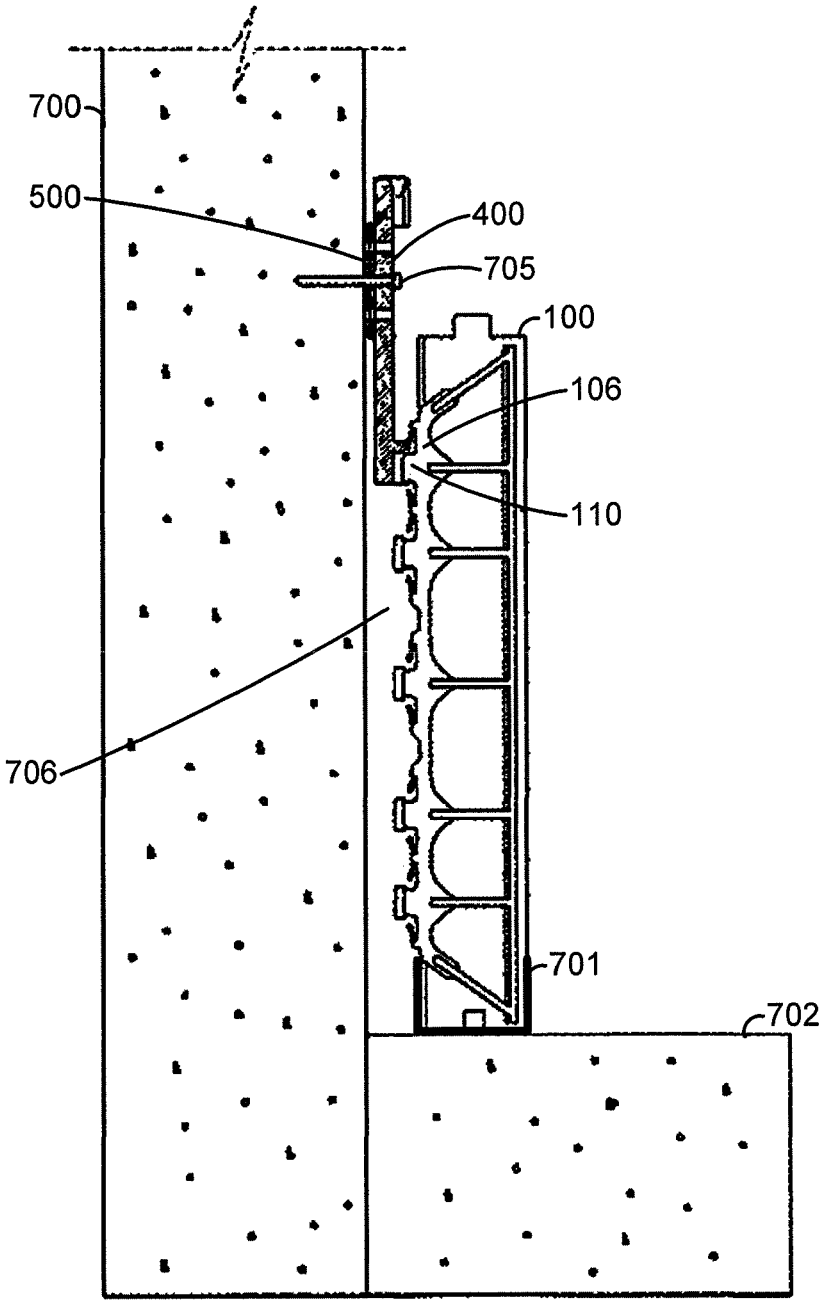
FIG. 7B illustrates additional steps in the wall insulation method in accordance with the principles of the invention.
Figure 7C:
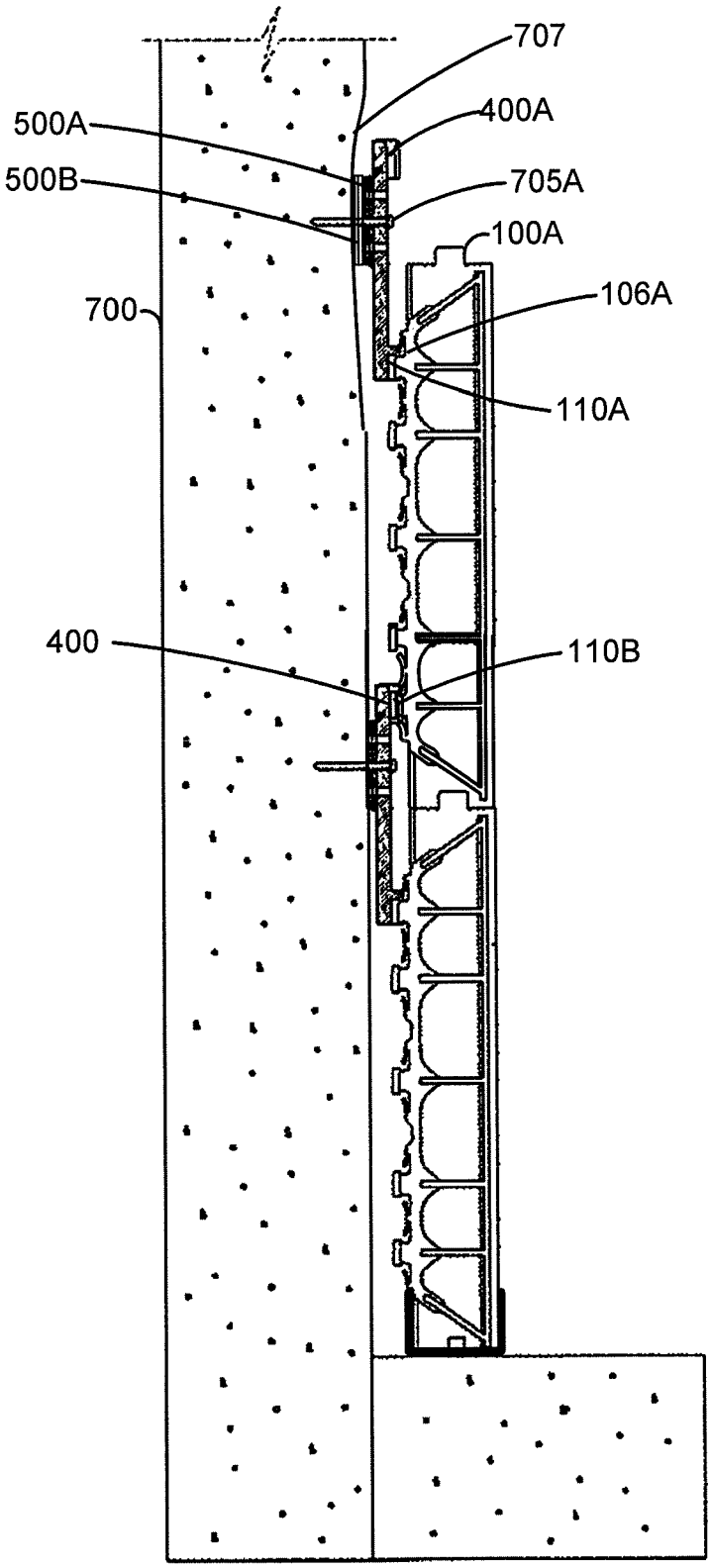
FIG. 7C illustrates additional steps in the wall insulation method in accordance with the principles of the invention.

FIGS. 7A-7C illustrate one exemplary method for using panel 100, clip 400, and one or more shims 500 to insulate a wall 700. Wall 700 may be an existing wall and the insulation added as part of a retrofit or renovation, or wall 700 and the insulation added as shown in FIGS. 7A-7C may be components of a new construction project. The example shown is in the context of a poured concreted basement wall 700, but the techniques illustrated may also applicable to other kinds of walls, including exterior walls of buildings, as the skilled artisan will recognize.

In a first step, shown in FIG. 7A, a channel 701 may be fixed to a floor 702 near wall 700. Channel 701 may preferably be a generally U-shaped channel having two walls 703 and 704 spaced apart by a distance selected to accommodate the thickness of panel 100. Channel 701 may be made, for example, of galvanized sheet steel formed into a U-shape, may be molded or extruded from a polymer such as polypropylene, high impact polystyrene (HIPS), or acrylonitrile butadiene styrene (ABS), or may be made from another suitable material by any suitable means. The heights of walls 703 an 704 need not be equal. Channel 701 may be affixed to floor 702 by an adhesive, nails, screws, or any other suitable method or combination of methods, and is spaced from wall 701 by a distance selected to accommodate the attachment features and clips that will be used to affix a panel, as well as to accommodate any irregularities in wall 700, and to provide an insulating air gap and/or moisture drainage channel if desired.

As shown in FIG. 7B, bottom 102 of panel 100 is placed in channel 701. A clip 400 is engaged with one of attachment features 110 of embedded web member 106. A shim 500 is removably attached to clip 400, and clip 400 and shim 500 are affixed to wall 700 using a fastener 705 such as those described below. Shim 500 thus, in concert with clip 400 and web member 106, contributes to the distance by which its respective attachment feature 100 is spaced from wall 700. Shim 500 may be removably attached to clip 400 and clip 400 removably attached to or otherwise engaged with attachment feature 110 before placement of panel 100, so that panel 100, clip 400, and shim 500 can be conveniently handled as a unit by a single installer, leaving a hand free to drive fastener 705. For example, protrusion 413 of clip 400 may snap under one of flexible tip features 111 of web member 106, removably attaching clip 400 to web member 106. Alternatively, panel 100 may be placed in channel 801, and then clip 400 and shim 500 added in any convenient order.

Fastener 705 is preferably a threaded screw or fastener, or a powder-driven fastener such as are available from ITW Ramset of Glendale Heights, Ill., USA. Any suitable fastener may be used. Typically two or three clips 400 and any required shims 500 would be used per panel 100. Once clips 400 are affixed to wall 700, panel 100 is fixed in place. When the spacing of channel 701 from wall 700 is properly chosen and appropriate shims 500 are used, panel 100 is vertical, and is constrained by channel 701 and clip 400 a fixed distance away from wall 700. In some embodiments, panel 100 is spaced from wall 701 by a distance greater than ¼ inch, providing an insulating air gap and/or a moisture drainage channel 706. In some embodiments, drainage channel 706 may be, for example, about 1 inch wide, subject to irregularities in wall 700 and surface features of panel 100.

Once a first course, or at least a portion of a first course, of panels 100 is affixed to wall 700, a second course may be installed above the first course, as shown in FIG. 7C. Preferably, the panels in the second course are displaced longitudinally from those in the first course so that the panel-to-panel joints in each course are displaced from the joints in the first course, similar to the way bricks are staggered in typical brickwork. The displacement is preferably equal to the spacing of the web members within the panels, so that the web members of the panel align vertically.

To place the second course including a second panel 100A, a clip 400A and any required shims are attached to an upper attachment feature 110A of panel 100A. In this example, an irregularity 707 in wall 700 has required that two shims 500A and 500B be used to accommodate the irregularity and maintain the verticality of panel 110A. The combined thickness of shims 500A and 500B thus contributes to the distance by which their respective attachment feature 110A is spaced from wall 700. Irregularity 707 is an indentation in wall 700. If a bulge is encountered in wall 700, a clip may be used without any shims, or with a shim that is thinner than shim 500. A lower attachment feature 110B of panel 100A is guided into and received in the mating opening of already-placed clip 400. Features molded into the foam edges of the panels may also assist in aligning the panels. Clip 400A and its associated shims are then affixed to wall 700 using a fastener 705A, similar to fastener 705.

This process is repeated along the wall (for example around the room in a basement application) and from floor to ceiling to insulate all of wall 700. The uppermost panel can be cut to fit if necessary. For example, in a basement application, the height of the uppermost course of panels 100 will depend on the overall ceiling height. If only 12 inches of wall height remain to be insulated with the uppermost course of panels, the panels can be ripped to a 12 inch height, and the uppermost clip 400 can be attached to any convenient one of attachment features 110 of the uppermost panel. Any convenient one of through holes 408 in the uppermost clip can be used to fasten the clip to the wall. The clip may also be cut down if needed, as the upper connection feature 405 of the upper part of the clip will not be needed.

Figure 7D:
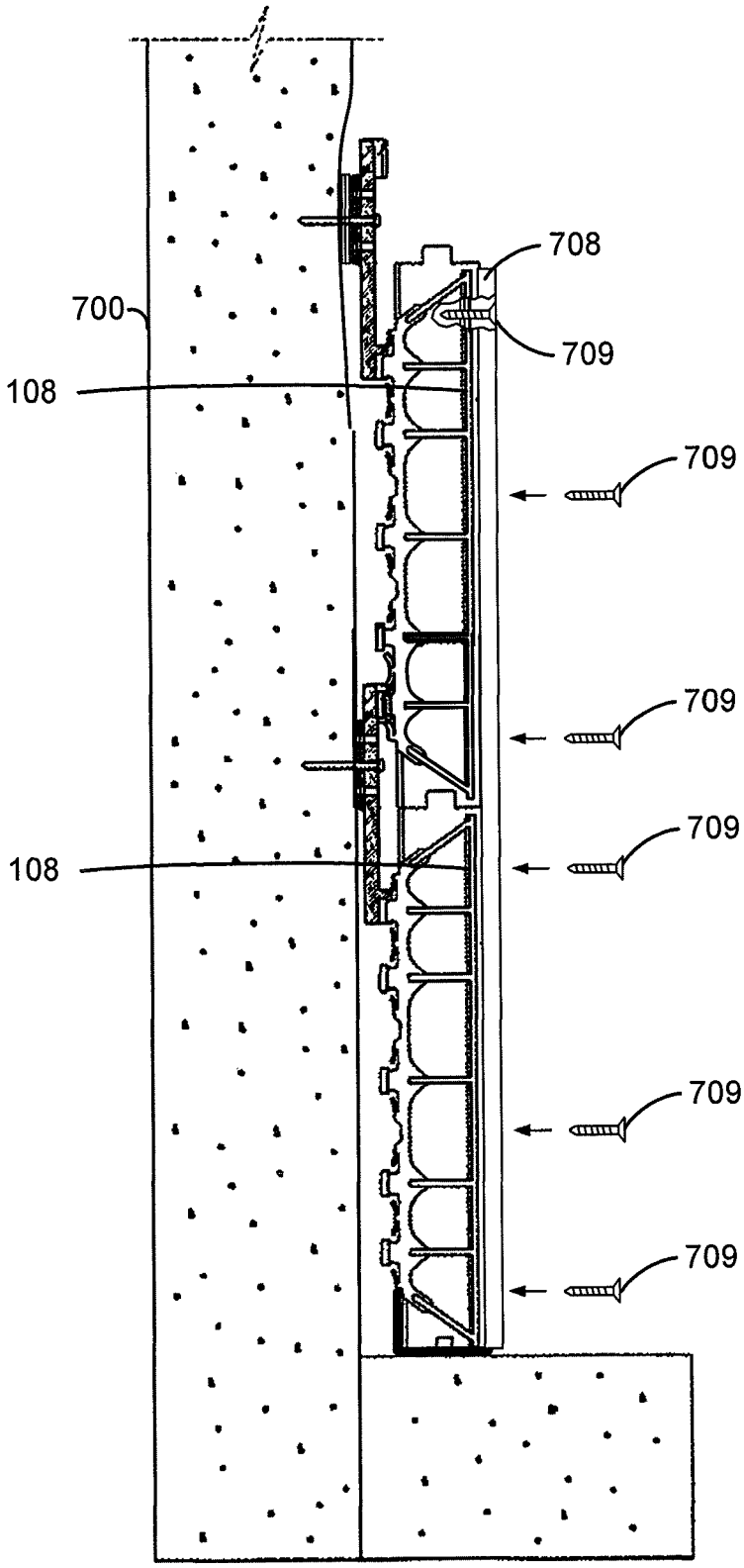
FIG. 7D illustrates the attachment of a wall covering, in accordance with the principles of the invention.

Once the insulation panels are in place, finishing materials can be applied. For example, drywall board can be screwed to the wall in a manner much like that used to apply drywall board to a wood framed wall by simply screwing into end plates 108 of web members 106. Preferably, web members 106 are spaced apart along the length of the panels such that they form vertical attachment areas similar in size and spacing to that provided by studs in a wood-framed wall. Electrical wiring, plumbing lines, and the like can be installed e.g., in gap 706, using techniques well known to one familiar with construction using insulating concrete forms. FIG. 7D illustrates the application of drywall board 708 to the wall, using screws 709 screwed into end plates 108.

Insulating by these methods using panels having a thickness of 2.5 inches can add an insulation value of about R-11 to an existing wall. As will be appreciated by one of skill in the art, the components and techniques described above provide for insulating a wall and preparing it for finishing in a quick, clean, and efficient manner. The materials are moisture and mold resistant, and the attachment to the wall is secure and strong. Walls that are not precisely vertical or include other irregularities are easily accommodated.

Many variations are possible within the scope of the appended claims. For example, clip 400 is generally elongate and intended to be used with its long axis in a vertical orientation, but other kinds of clips are contemplated and intended to be encompassed by the appended claims. For example, a clip may be used in a horizontal orientation, may have an overall height similar to or greater than its width, may include large protruding connection features, or may vary in other ways from clip 400. In some embodiments, the attachment features of the web members may be recessed inside the foam portion of a panel, and a clip may include connection features that reach inside the panel to attach to the web attachment features. In some embodiments, a clip may engage with two panels adjacent on the same course. Examples of additional clip and shim embodiments and attachment methods are discussed below, and one of skill in the art will recognize that many other variations are possible.

Figure 8:
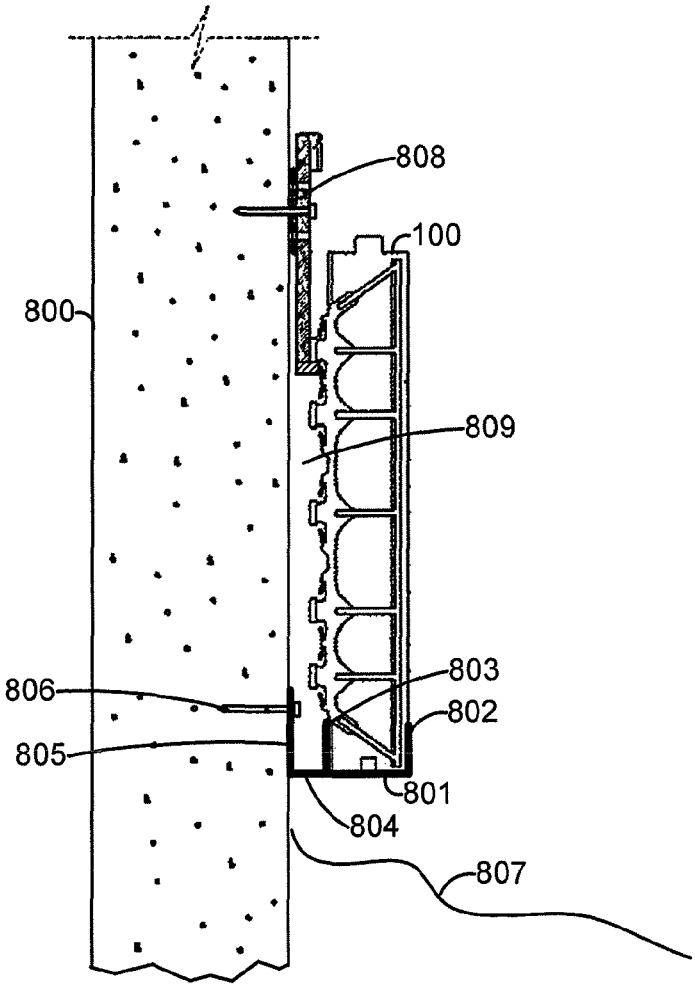
FIG. 8 illustrates insulation of a portion of a wall constructed in accordance with other methods of the invention.

FIG. 8 illustrates another embodiment and attachment method, which may be especially useful for insulating exterior walls, but may be used in interior applications as well. In this embodiment, an optional bracket 801 fastens to wall 800, rather than to a floor. Exemplary bracket 801 includes first and second walls 802 and 803 into which panel 100 fits. Bracket 801 further includes a spacer section 804 and a third wall 805. Walls 802, 803, and 805 need not all be of the same height, and in fact wall 805 may preferably be taller than walls 802 and 803. Bracket 801 may be fastened to wall 800 via bracket wall 805 using any suitable fastener 806 such as those discussed above. Spacer 804 sets the spacing of the bottom of panel 100 from wall 800. Bracket 801 may be leveled independent of any floor or ground surface 807 below the new insulation. Bracket 801 may for example molded or extruded from a polymer such as polypropylene, high impact polystyrene (HIPS), acrylonitrile butadiene styrene (ABS), or may be made from another suitable material by any suitable means. A clip 808, shown in detail in FIG. 10 discussed below, attaches the upper part of panel 100 to wall 800. Clip 808 is similar to clip 400. Alternatively, a clip identical to clip 400 may be used.

Once panel 100 is affixed to wall 800, a moisture drainage channel 809 is formed between panel 100 and wall 800. Drainage channel may be, for example, greater than ¼ inch wide, and is preferably nominally about 1 inch wide, subject to irregularities in wall 800 and surface features of panel 100.

Figure 9:
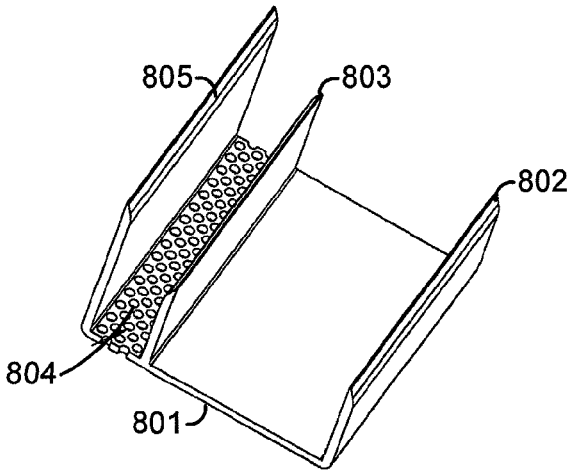
FIG. 9 illustrates one embodiment of a channel constructed in accordance with the principles of the invention.

FIG. 9 shows an oblique view of a short section of an exemplary bracket 801. In practice, bracket 801 may extend along the entire underside of the insulation added to the wall. Spacer section 804 may be perforated to facilitate the drainage of moisture from behind the insulation. The holes in spacer 804 are preferably sized large enough to permit the drainage of moisture, but small enough to prevent insect intrusion. Alternatively or additionally, a screen may be placed in bracket 801.

Figure 10:
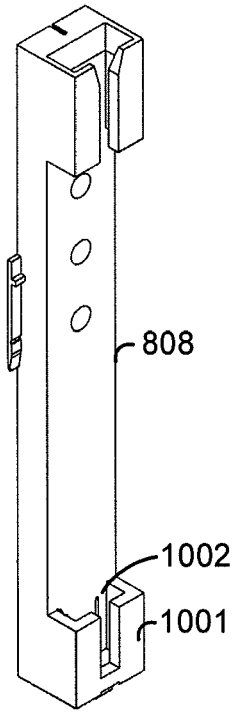
FIG. 10 illustrates an alternate embodiment of a clip constructed in accordance with principles of the invention.

FIG. 10 illustrates additional details of clip 808, which may be especially suitable for exterior applications. In many respects, the features of clip 808 are identical to clip 400. However, lower connection feature 1001 differs in that it is a slotted pocket open at the top side 1002, rather than at the bottom side as was the case with clip 400. Clip 808 can still be snapped onto one of the attachment features 110 of a panel 100, but this is accomplished by an upward motion rather than a downward motion. An advantage of this kind of clip is that, once affixed to the wall being insulated, clip 808 can help support the panel 100 to which it is attached. This is especially helpful in exterior applications where the bottom course of panels does not rest on a floor. As is apparent from FIG. 8, having panel 100 supported by clip 808 may at least partially relieve bracket 801 of the need to support panel 100, and bracket 801 may accordingly be made of materials that would not otherwise have the strength to support panel 100.

Figure 11:
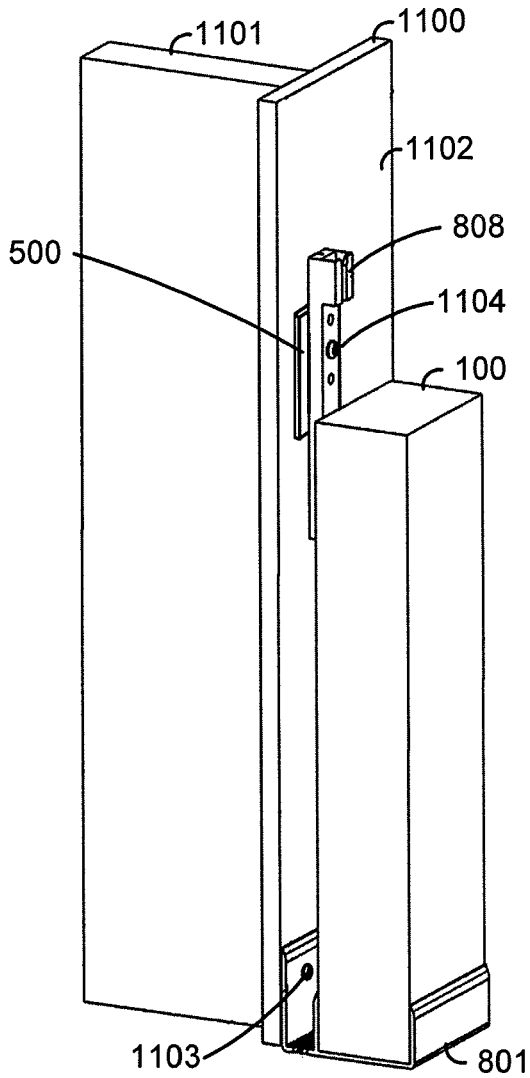
FIG. 11 illustrates another embodiment for insulation of a portion of a wood-framed wall using a channel of the invention.

FIG. 11 illustrates the insulation of an exterior surface of a wood frame wall, in accordance with another embodiment using a channel. In this case, wall 1100 comprises studs 1101 and exterior sheeting 1102, as well as any exterior wrap or moisture barrier such as building paper or Tyvek® (not shown). Wall 1100 may also include an existing wall finish, such as siding, paneling, stucco, or another kind of finish (also not shown). A channel such as bracket 801 is fastened to wall 1100, preferably by fasteners 1103 placed to fasten to studs 1101. Bracket 801 holds the lower portion of panel 100 a fixed distance from wall 1100. A clip such as clip 808 attaches to an attachment feature (not visible) of panel 100, and is fastened to wall 1100 using a fastener 1104. A clip similar to clip 400 may also be used, or another clip in accordance with embodiments of the invention. One or more shims 500 may be used as needed to achieve a plumb exterior wall. Preferably, fastener 1104 is also positioned to engage a stud 1101, for maximum strength. Courses of panels are placed along and upward on wall 1100 as previously described. Once the insulation layer is complete, any suitable exterior finish may be applied, for example making use of end plates 108 embedded or partially embedded in panels 100. For example, siding could be screwed to panels 100 in a manner similar to how it would be attached to a wood frame wall. Or a mesh could be attached to wall 1100 to support a stucco finish. Many other exterior finishes are possible.

Figure 12A:
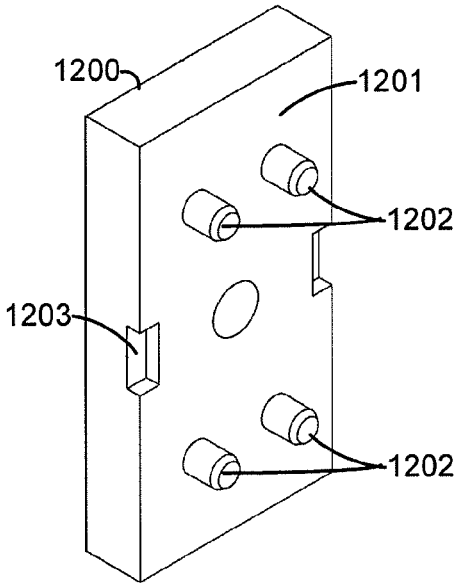
FIG. 12A illustrates an alternative embodiment of a shim in accordance with the principles of the invention.

FIGS. 12A-12D illustrate alternative shims and clips, and a method of stacking shims, according to other embodiments. As is shown in FIG. 12A, a shim 1200 according this embodiment has a main portion 1201 that establishes the thickness of the shim, and a set of protrusions 1202 that cooperate with shim receiving features in a clip or another shim to removably attach shim 500 to the clip or other shim. Notches 1203 may be used for separating removably attached parts, as described below.

Figure 12B:
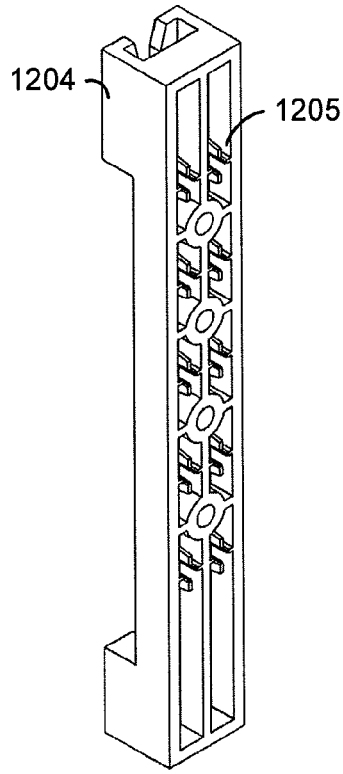
FIG. 12B illustrates an alternative embodiment of a clip in accordance with the principles of the invention.
Figure 12C:
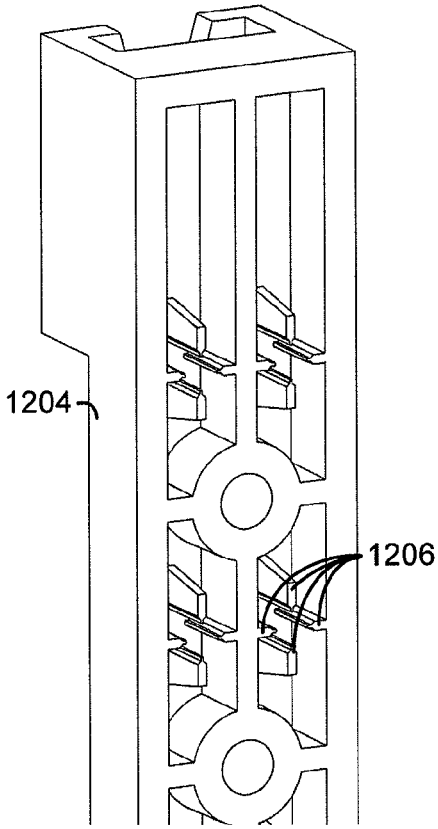
FIG. 12C illustrates shim receiving features of the clip of FIG. 12B.

In accordance with this embodiment, a clip 1204 as shown in FIG. 12B includes shim receiving features 1205 molded into its back side. FIG. 12C is an enlargement of the shim receiving features 1205. Shim receiving features 1205 include a plurality of compliant ribs 1206, spaced to receive protrusions 1202 in an interference fit. The compliance of ribs 1206 may occur due to bending of ribs 1206 to accommodate protrusions 1202, or may occur due to partial crushing of ribs 1206, or to a combination of these effects. Shim 1200 may include similar receiving features to enable stacking of shims.

Figure 12D:
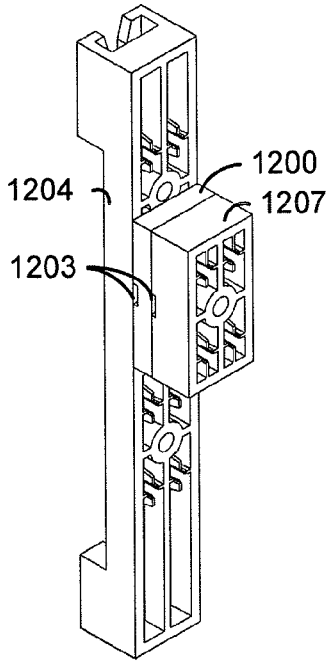
FIG. 12D illustrates shims attached to the clip of FIG. 12B.

FIG. 12D illustrates clip 1204 with two shims 1200 and 1207 attached to it in a stacked arrangement. Notches 1203 may be used for separating the shims and clip if desired, for example by the insertion of a screwdriver blade or other prying tool. As is apparent in FIG. 12D, shims of differing thicknesses may be provided.

Figure 13A:
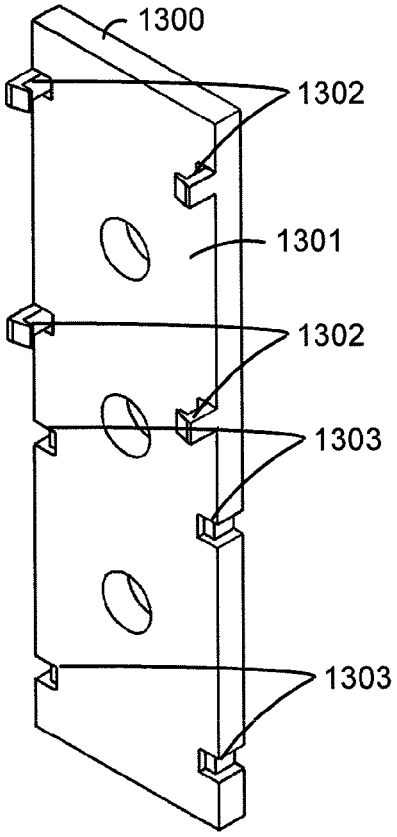
FIG. 13A illustrates another alternative shim in accordance with the principles of the invention.
Figure 13B:
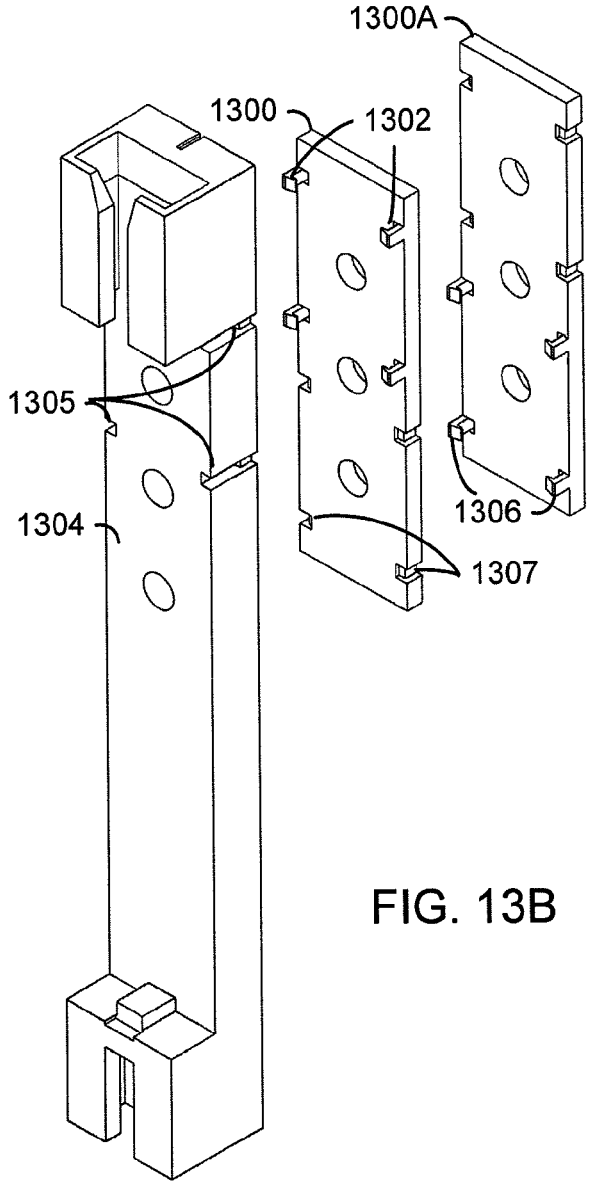
FIG. 13B illustrates another alternative clip in accordance with the principles of the invention.
Figure 13C:
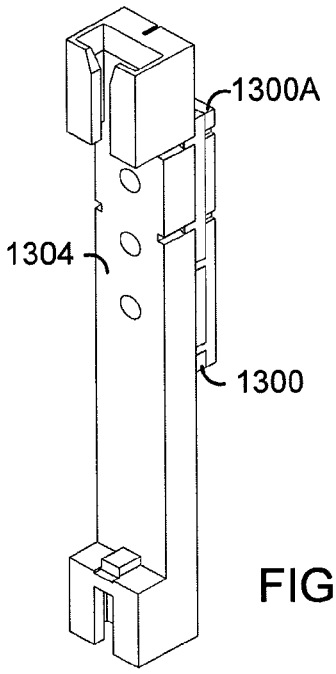
FIG. 13C illustrates the shim according to FIG. 13A attached to the clip of FIG. 13B.

FIGS. 13A-13C illustrate additional shims and clips and yet another method of stacking shims. As is shown in FIG. 13A, a shim 1300 includes a main portion 1301 that establishes the thickness of the shim, a set of hook features 1302, and a set of hook receiving features 1303. While four hook features 1302 and hook receiving features 1303 are shown, one of skill in the art will recognize that other numbers of such features may be used. Hook features 1302 cooperate with receiving features 1305 preferably molded into a clip 1304, shown in FIG. 13B, to enable shim 1300 to snap onto clip 1304. Thus, shim 1300 and clip 1304 can be removably attached for convenient handling. FIG. 13B also shows an additional shim 1300A, which may be identical to shim 1300. Shim 1300A has been rotated 180 degrees with respect to shim 1300, so that the hook features 1306 of shim 1300A align with hook receiving features 1307 of shim 1300, and shim 1300A can be snapped onto shim 1300. Any number of shims can be stacked in this manner, to achieve a desired aggregate shim thickness. FIG. 13C shows clip 1304 and shims 1300 and 1300A in their assembled state.

Figure 14A:
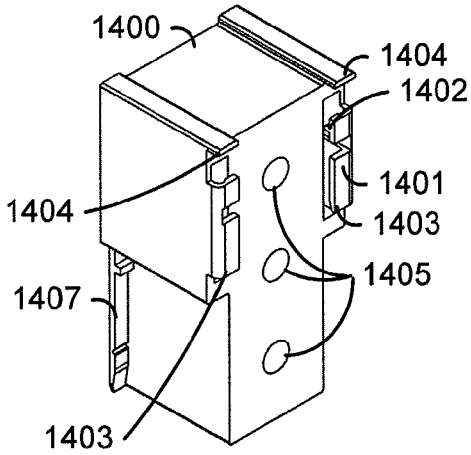
FIGS. 14A and 14B illustrate an additional shim in accordance with other embodiments of the invention.
Figure 14B:
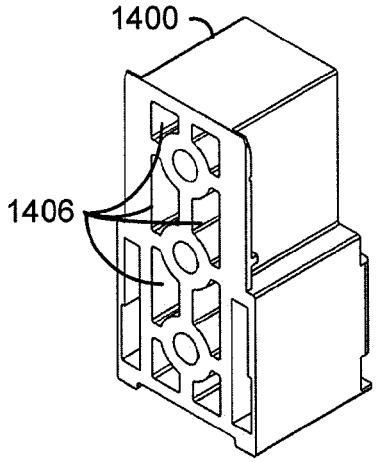

FIGS. 14A and 14B illustrate a shim 1400 in accordance with another embodiment. Exemplary shim 1400 is thickened substantially as compared with shim 500. For example the thickness of shim 1400 may be as much as one inch or more. Shim 1400 otherwise includes many of the same features as shim 500, including a C-shaped channel 1401 configured to engage tabs 409 of clip 400 or another similar clip. A male snap feature 1402 is positioned to snap into a depression of a clip when shim 1400 has reached its proper position, to removably attach shim 1400 to the clip. Ends 1403 of C-shaped channel 1401 are also positioned to meet stops provided on the clip to limit the travel of shim 1400. Tabs 1404 "error-proof" the assembly so that shim 1400 cannot be placed on the clip in an incorrect orientation. Through holes 1405 are configured to receive fasteners for affixing an assembly including shim 1400 to a wall. The increased thickness of shim 1400 is enabled at least in part by coring out portions of the back side of shim 1400, as indicated at 1406. These cored pockets serve to reduce the amount of material required to make shim 1400, and improve the moldability of the part. Shim 1400 also includes features 1407 for receiving additional shims in a stacked arrangement, as has been previously described.

A shim of increased thickness such as exemplary shim 1400 may be used for accommodating especially large deviations in the wall being insulated, but also may enable additional uses of the components and systems according to embodiments of the invention.

Figure 15:
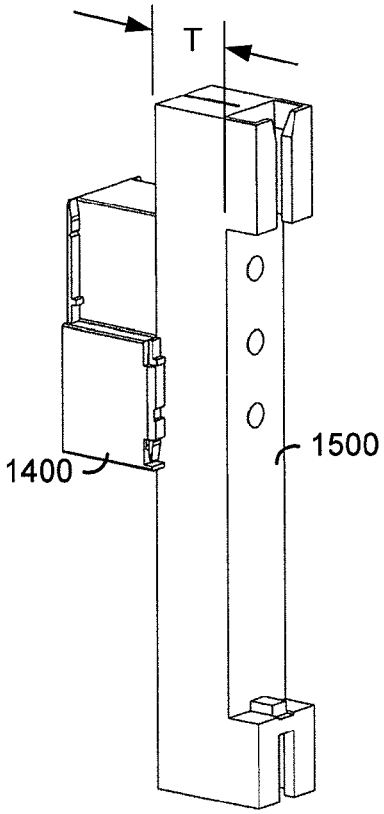
FIG. 15 illustrates another alternative clip in accordance with other embodiments of the invention.

For example, FIG. 15 illustrates a strengthened clip 1500, in accordance with embodiments of the invention. Shim 1400 is also shown attached to clip 1500. Clip 1500 is similar in may respects to clip 400, and includes many of the same features, but has a thickness T that is increased as compared with clip 400. The added thickness strengthens clip as compared with clip 400. The added strength may be helpful in certain applications.

Figure 16:
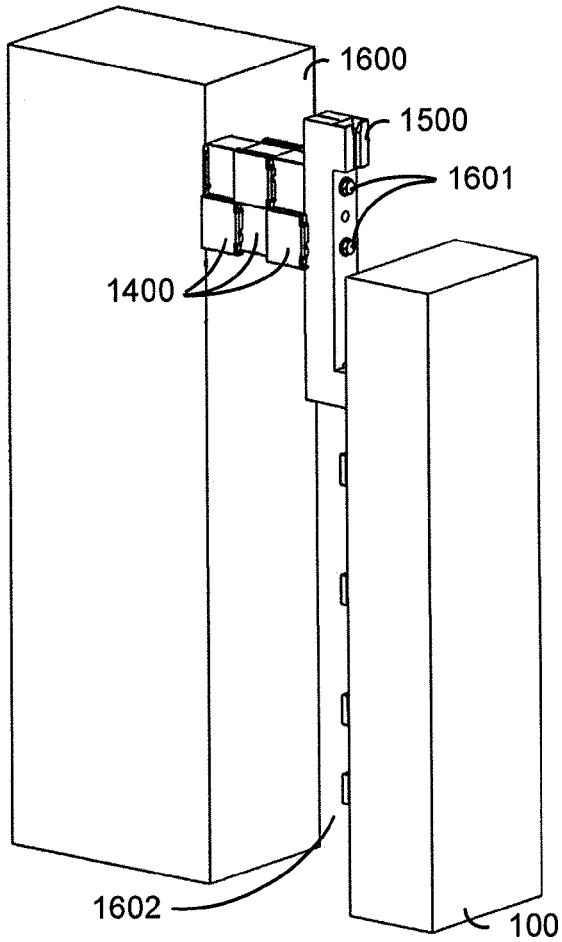
FIG. 16 illustrates an application of the shim of FIGS. 14A and 14B and the clip of FIG. 15.

FIG. 16 illustrates an application in which the added strength of clip 1500 and the added thickness of shim 1400 may be used to advantage. In the embodiment of FIG. 16, several shims 1400 have been stacked with clip 1500, which is in turn attached to panel 100. The assembly is affixed to wall 1600 using fasteners 1601. An enlarged cavity 1602 is thus created between wall 1600 and panel 100. By filling cavity 1602 with fresh concrete or other durable building material, a strengthened supporting wall with insulation and structural mounts (the end plates in panels 100) for a wall finish is provided. This technique may be used, for example, when an existing wall has been weakened due to poor quality concrete or other damage. Strengthened clip 1500 and multiple fasteners 1601 enable the assembly to withstand the hydrostatic pressure exerted by the freshly poured concrete in cavity 1602. This kind of installation involves fewer steps and can be done more quickly and at lower cost than some other wall repair techniques. The thickness of the fresh concrete pour can be determined by the number and thickness of shims used.

Figure 17:
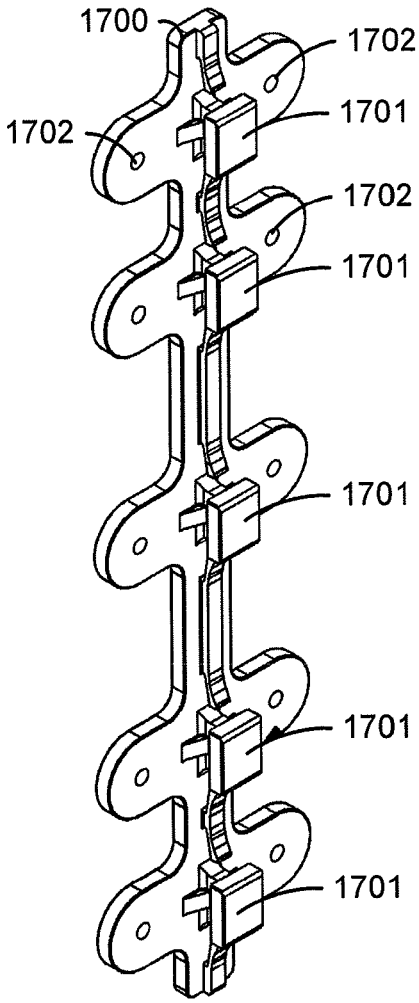
FIG. 17 illustrates an embodiment of a wall-mounted web member constructed in accordance with the principles of the invention.
Figure 18:
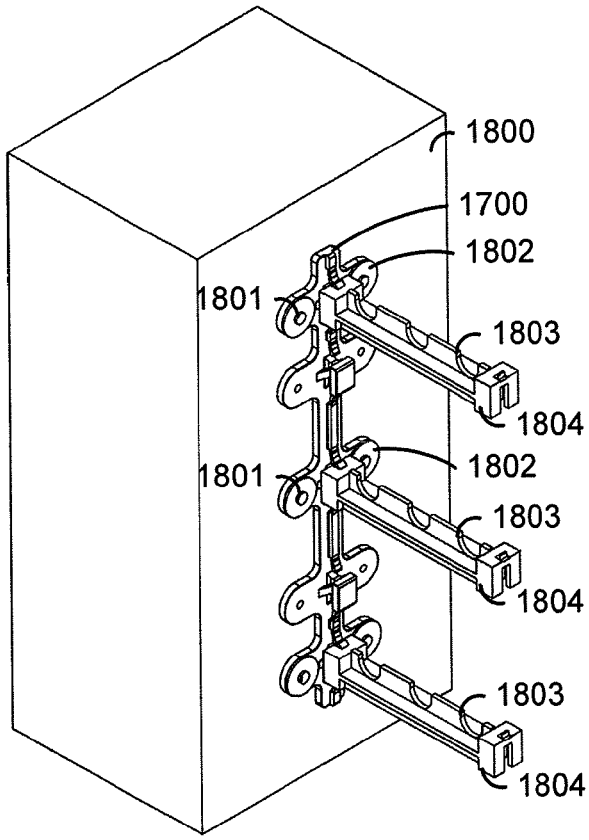
FIG. 18 illustrates the web member of FIG. 17 mounted to a wall with connectors extending therefrom.
Figure 19:
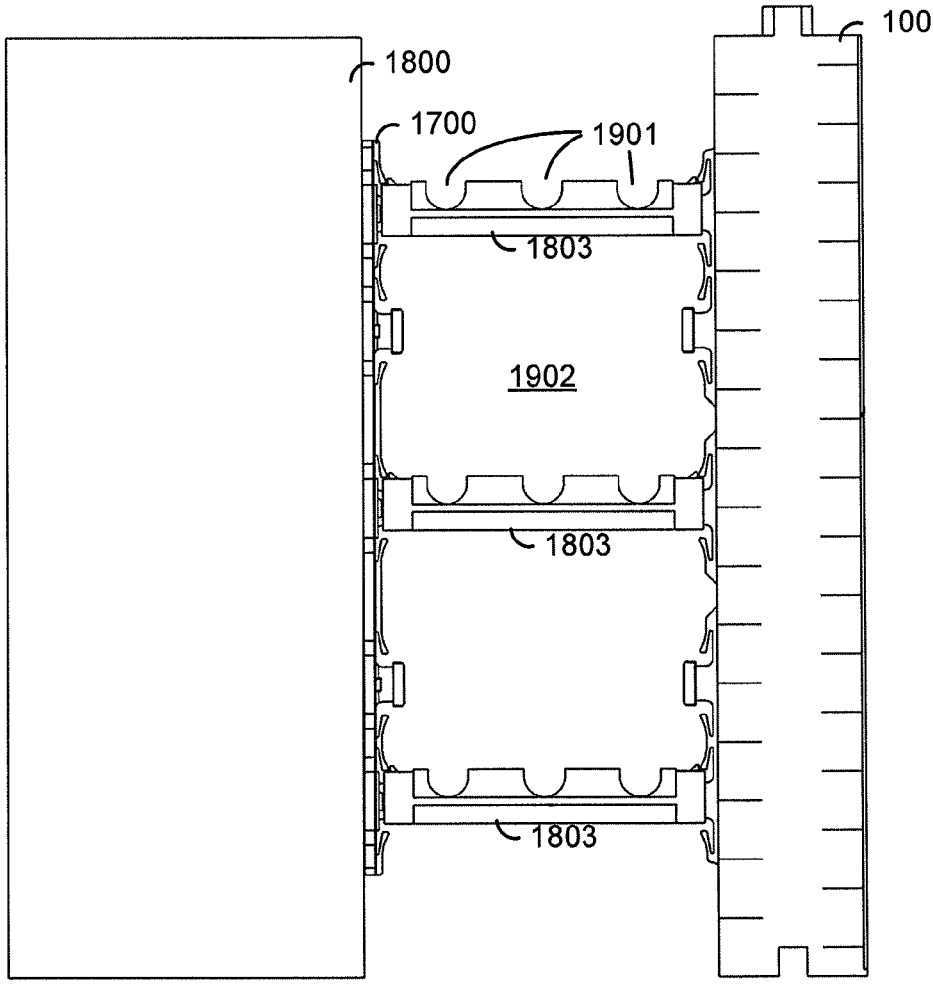
FIG. 19 is a side orthogonal view of a panel attached to a wall via connectors, in accordance with the embodiment of FIG. 18.

FIGS. 17-19 illustrate another method of creating an expanded cavity, in accordance with other embodiments of the invention. FIG. 17 illustrates a wall-mountable web member 1700 in accordance with embodiments of the invention. Wall-mountable web member 1700 includes attachment features 1701 similar to attachment features 110 of web member 106 of panels 100. Preferably, attachment features 1701 are spaced vertically the same distance apart as attachment features 110. Wall-mountable web member 1700 includes through holes 1702 (not all labeled in FIG. 17) configured to receive fasteners for mounting wall-mountable web member 1700 to a wall.

FIG. 18 illustrates wall-mountable web member 1700 mounted to a wall 1800, using any suitable fasteners 1801. Fasteners may be provided in some or all of through holes 1702, and washers 1802 may also be used with fasteners 1801. Also illustrated in FIG. 18 are several connectors 1803. Connectors 1803 may be of the kind described in U.S. Pat. No. 6,438,918, which is incorporated by reference herein in its entirety. Connectors 1803 include features at one end configured to complementarily engage with attachment features 1701 of wall-mountable web member 1700, and features an another end configured to complementarily engage with attachment features 110 of web members 106 in panels 100. In this embodiment, web members 106 may be referred to as panel web members, in order to more clearly distinguish them from wall-mountable web member 1700. If attachment features 110 and 1701 are identical, connectors 1803 may be symmetric and reversible. Outer ends 1804 of connectors 1803 thus provide a way to connect a panel 100. A number of wall-mountable web members 1700 may be provided and affixed to wall 1800, to connect to multiple panel web members 106 in panel 100 and to panel web members 106 in additional panels.

FIG. 19 is a side orthogonal view of a panel 100 attached to wall 1800 via connectors 1803, in accordance with embodiments of the invention. In this way, an enlarged cavity 1902 is created between wall 1800 and panel. Cavity 1902 may be filled with fresh concrete to strengthen or repair wall 1800. Panels 100 provide insulation to the completed wall, and provide mounting structures for finishes that may be applied to the wall. The size of cavity 1902, that is the spacing between wall 1800 and panel 100, is determined in part by the length of connectors 1803. Preferably, several lengths of connectors are available, and a suitable length can be chosen for a particular application. In some embodiments, multiple wall-mountable web members 1700 and panels 100 are used to complete a first course of panels 100 along wall 1800, and other courses of panels 100 above the first course, substantially to the height of wall 1800, so that substantially all of wall 1800 can be strengthened or repaired.

Connectors 1803 may include saddles 1901 for holding rebar or other reinforcing members to be included in the poured concrete.

Figure 20A:
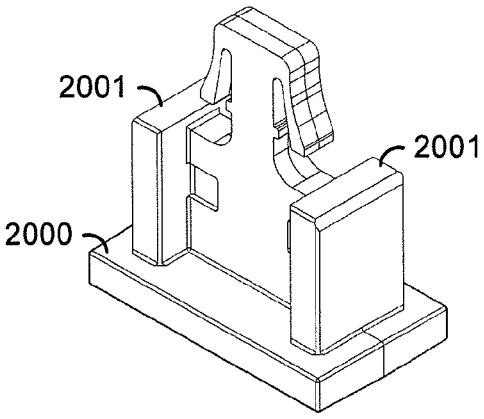
FIG. 20A illustrates an embodiment of a connector link (splice) constructed in accordance with the principles of the invention.
Figure 20B:
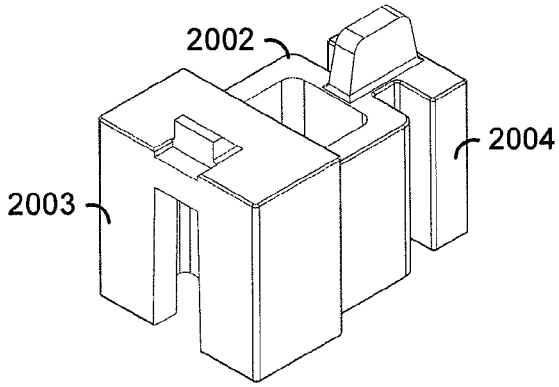
FIG. 20B illustrates an embodiment of a connector extender constructed in accordance with the principles of the invention.

In addition, the spacing between wall 1800 and panel 100 can be further expanded using connector links or extenders. FIG. 20A illustrates a connector link (splice) 2000 having attachment features 2001 on both ends. By attaching a connector 1803 to each end of link 2000, an extended connector can be formed. An example connector link is described in more detail in U.S. Pat. No. 6,314,697, which is incorporated by reference herein in its entirety. FIG. 20B illustrates a connector extender 2002, having an attachment feature 2003 on one end similar to attachment features 110, and a connection feature 2004 similar to connection feature 404 at the other end. Extender 2002 can be added to a connector 1803 to extend the connector. An example connector extender is described in more detail in U.S. Pat. No. 6,609,340, which is incorporated by reference in its entirety herein.

Figure 21:
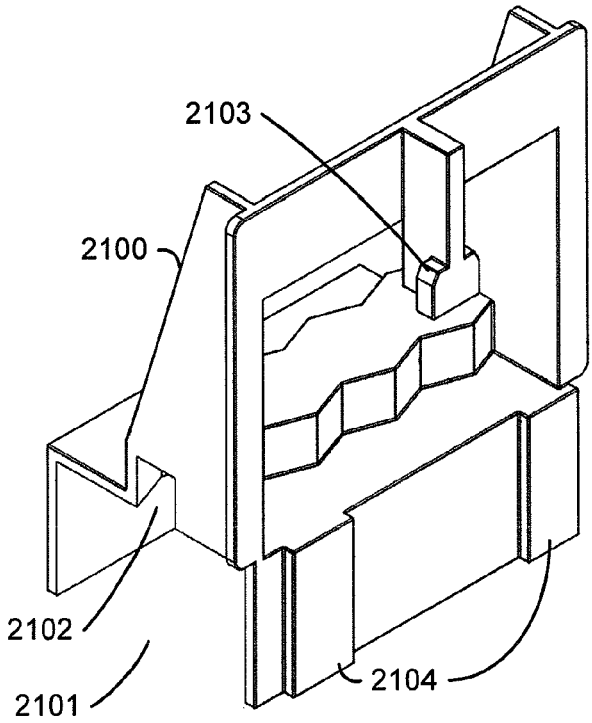
FIG. 21 illustrates an embodiment of an assembly jig constructed in accordance with the principles of the invention.

FIG. 21 illustrates an assembly jig 2100 in accordance with embodiments of the invention, for assisting in the assembly of the components described above. Jig 2100 includes an inverted U-shaped channel 2101 sized and shaped to fit over the top 101 of a panel 100. Within channel 2101 is a further sculpted channel 2102, configured to complementarily mate with a feature that protrudes from the top of panel 100. Because panels 101 are consistently molded, the engagement of sculpted channel 2102 with panel 100 constrains jig 2100 to a particular position along the length of the panel 100. A user will choose the particular position aligned with one of web members 106 of panel 100. Additional features 2104 molded into jig 2100 may mate with other features of panel 100, for example ribs on the back side of panel 100, further aiding in the alignment of jig 2100 with a web member 106.

Jig 2100 also includes a clip guide feature 2103, configured to mate with and properly align the upper connection feature of a clip such as clip 400 or clip 1204.

Figure 22:
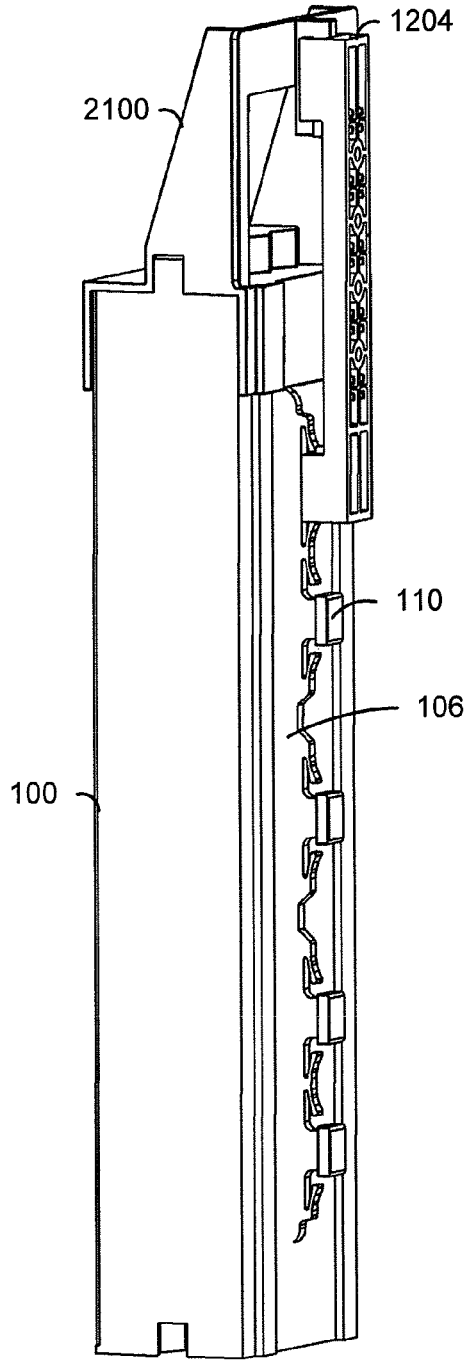
FIG. 22 illustrates the use of the assembly jig of FIG. 21.

FIG. 22 shows jig 2100 in place on a panel 100, in accordance with embodiments of the invention, for aligning a clip 1204. To use jig 2100, the user would place jig 2100 on panel 100, aligned with a web member 106, and then attach clip 1204 to one of attachment features 110 of web member 106, simultaneously engaging clip guide feature 2103 with the connection feature at the top of clip 1204. (One of ordinary skill in the art will recognize that clip 1204 could alternatively be attached to web member 106 before jig 2100 is introduced.) In this state, clip 1204 is constrained in all degrees of freedom in relation to panel 100, and is in the position relative to panel 100 that it will reside in once affixed to the wall. Jig 2100 restrains clip 1204 against any looseness that may exist in its attachment to web member 106.

Having clip 1204 constrained in this way facilitates the easy handling of panel 100 and clip 1204 as a unit, and eases the determination of the required shim thickness for this particular clip 1204. To measure for shims, panel 100 is held plumb with its bottom constrained by a channel, bracket, or anther panel, and the distance from clip 1204 to the wall is measured. The appropriate number of shims can then be attached to clip 1204, and the clip and shims affixed to the wall. If panel 100 is part of an upper course of panels, it may simply be held parallel to the lower course in order to plumb it, presuming that the lower course was installed plumb. Once clip 1204 and any shims are affixed to the wall, jig 2100 can simply be lifted off of panel 100 and used at the next clip installation.

Figure 23A:
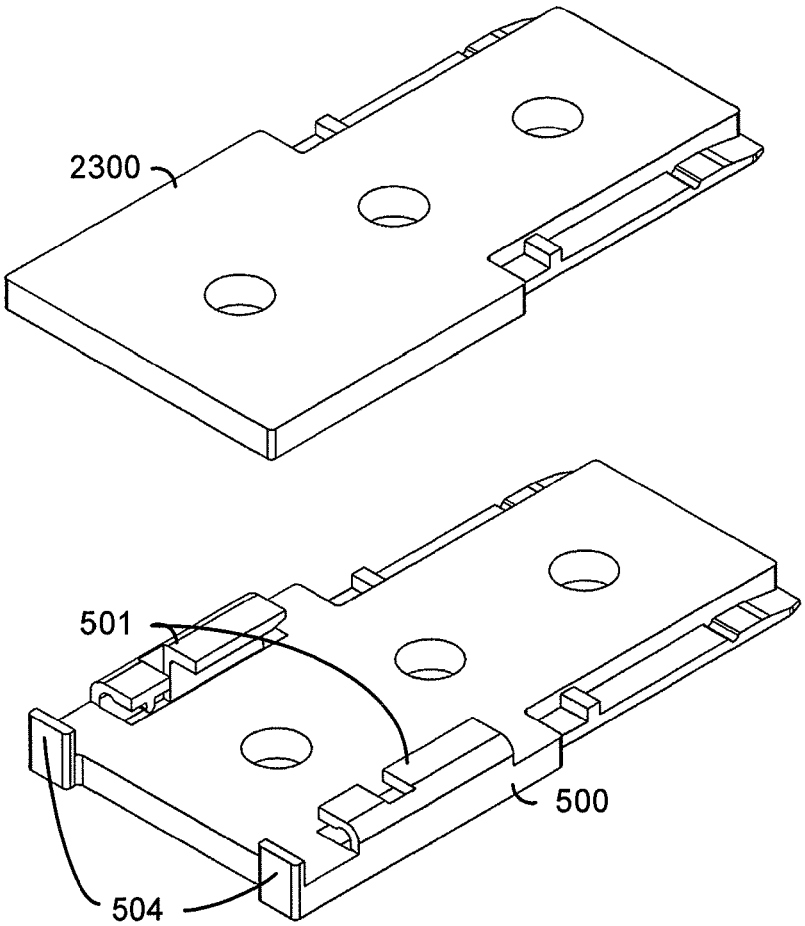
FIGS. 23A and 23B illustrate yet further embodiments of a shim in accordance with the principles of the invention.
Figure 23B:
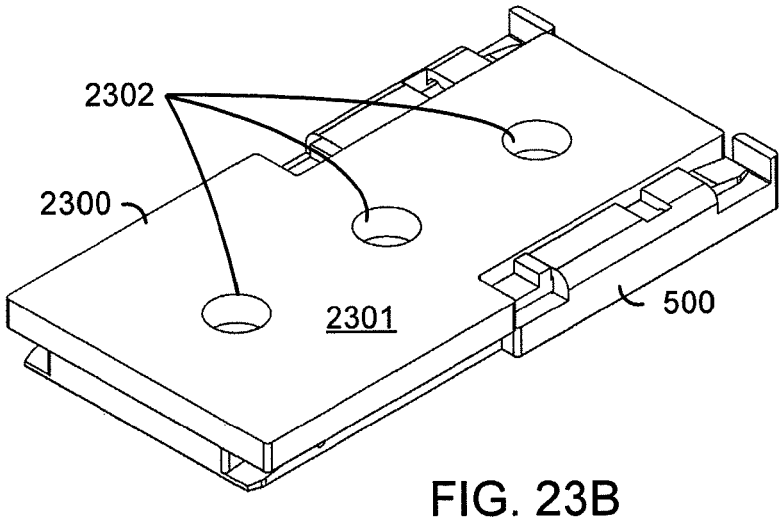

FIGS. 23A and 23B illustrate an additional configuration of a shim 2300 in accordance with additional embodiments of the invention. Exemplary shim 2300 is similar to and configured to attach to shim 500 in the manner previously described, except that shim 2300 lacks any feature equivalent to C-shaped channel 501 or "error proofing" tabs 504. As such, when shim 2300 is attached to shim 500 to create a stacked shim, the resulting stacked shim presents a flat (lacking protrusions) surface 2301. One of skill in the art will appreciate that any number of shims 500 can be stacked and one of shim 2300 added to the stack to create a stacked shim of a desired thickness and having top and bottom surfaces that are substantially flat and lack protrusions. The attachment features previously described ensure that the shims will remain attached during normal handling, facilitating ease of use in applications where unattached multiple shims would be difficult to handle. One or more through holes 2302 may align with holes in shim 500, so that the resulting stacked shim may be attached to a convenient surface using fasteners such as screws.

The stackable shims and shim systems described herein may find use in many other applications beyond the illustrated use in insulating a wall. For example, the stackable shim system of FIGS. 23A and 23B may be used in building construction to plumb door jambs, may be used to level machinery or furniture, or for any other application where shims are appropriate.

While embodiments of the invention have been described primarily in the context of adding insulation to existing walls as part of a retrofit or renovation, one of skill in the art will recognize that systems, components, and methods according to embodiments of the invention may be utilized in new construction as well.

The description given above is merely illustrative and is not meant to be an exhaustive list of all possible embodiments, applications or modifications of the invention. Thus, various modifications and variations of the described methods and systems of the invention will be apparent to those skilled in the art without departing from the scope and spirit of the invention. Although the invention has been described in connection with specific embodiments, it should be understood that the invention as claimed should not be unduly limited to such specific embodiments. Indeed, various modifications of the described modes for carrying out the invention which are obvious to those skilled in the art are intended to be within the scope of the appended claims.

What is claimed is:

1. A stackable shim system, comprising:

a first shim that includes a receiving feature, an attachment feature, and a main portion having a first thickness, the first thickness defined between a first surface and a second surface of the first shim;

a second shim that also includes a receiving feature, an attachment feature, and a main portion having a second thickness, the second thickness defined between a first surface and a second surface of the second shim;

wherein the receiving feature of each shim is configured to engage with the attachment feature of the other shim such that either shim can be removably attached to the other to create a stacked shim having a main portion having a thickness that is the sum of the first and second thicknesses;

wherein each of the first and second shims has at least first and second edges on opposite sides and extending between the respective first and second surfaces;

wherein the receiving feature of each shim comprises two tabs, one tab protruding from each of the first and second edges of the shim; and the attachment feature of each shim comprises a generally C-shaped channel configured to complementarily engage with the receiving feature of the other shim as the receiving feature slides into the attachment feature.

2. The stackable shim system of claim 1, wherein the two shims are substantially identical.

3. The stackable shim system of claim 1, wherein the two shims differ in thickness.

4. The stackable shim system of claim 1, further comprising a detent feature for holding the two shims in stacked arrangement.

5. The stackable shim system of claim 4, wherein the detent feature comprises a snap feature protruding from the generally C-shaped channel of one shim, and configured to snap into a depression in one of the tabs of the other shim.

6. The stackable shim system of claim 1, wherein:

each main portion defines at least one through opening for receiving a fastener; and when the first and second shims are attached to form the stacked shim, the openings align such that the stacked shim also defines a through opening for receiving a fastener.

7. A method of forming a stacked shim for taking up space and/or accommodating for irregularities in construction materials, the method comprising:

providing a first shim including a receiving feature, a first main portion having a first thickness, the first thickness defined between a first surface and a second surface of the first shim, and at least first and second edges on opposite sides and extending between the first and second surfaces of the first shim, the receiving feature comprising tabs protruding from the first and second edges of the first shim;

providing a second shim including an attachment feature and a second main portion having a second thickness, the second thickness defined between a first surface and a second surface of the second shim, the attachment feature comprising a generally C-shaped channel configured to complementarily engage with the receiving feature of the first shim as the receiving feature slides into the attachment feature; and removably attaching the first shim to the second shim by sliding the attachment feature of the second shim over the receiving feature of the first shim such that a stacked shim is formed having a main portion having a third thickness that is the sum of the first and second thicknesses.

8. The method of forming a stacked shim for taking up space and/or accommodating for irregularities in construction materials of claim 7, wherein the first and second shims are substantially identical.

9. The method of forming a stacked shim for taking up space and/or accommodating for irregularities in construction materials of claim 7, wherein the first and second shims differ in thickness.

10. The method of forming a stacked shim for taking up space and/or accommodating for irregularities in construction materials of claim 7, wherein removably attaching the first shim to the second shim comprises engaging a detent feature for holding the two shims in stacked arrangement.

11. The method of claim 10, wherein the detent feature comprises a snap feature protruding from the generally C-shaped channel of the second shim, and configured to snap into a depression in one of the tabs of the first shim.

* * * * *